US006460345B1

(12) United States Patent
Beebe et al.

(10) Patent No.: US 6,460,345 B1
(45) Date of Patent: Oct. 8, 2002

(54) CATALYTIC COMBUSTOR FLOW CONDITIONER AND METHOD FOR PROVIDING UNIFORM GASVELOCITY DISTRIBUTION

(75) Inventors: Kenneth Winston Beebe, Galway; Leslie Boyd Keeling, Niskayuna, both of NY (US)

(73) Assignee: General Electric Company, Schenectady, NY (US)

( * ) Notice: Subject to any disclaimer, the term of this patent is extended or adjusted under 35 U.S.C. 154(b) by 30 days.

(21) Appl. No.: 09/712,318

(22) Filed: Nov. 14, 2000

(51) Int. Cl.[7] ..... F02C 7/26
(52) U.S. Cl. ..... 60/777; 60/723; 60/751
(58) Field of Search ..... 60/777, 723, 751

(56) References Cited

U.S. PATENT DOCUMENTS

| | | | | |
|---|---|---|---|---|
| 3,709,473 A | | 1/1973 | Ito et al. | |
| 4,794,753 A | | 1/1989 | Beebe | |
| 4,845,952 A | | 7/1989 | Beebe | |
| 4,966,001 A | | 10/1990 | Beebe | |
| 5,161,366 A | | 11/1992 | Beebe | |
| 5,339,634 A | * | 8/1994 | Gale et al. | 431/7 |
| 5,461,864 A | * | 10/1995 | Betta et al. | 60/723 |
| 5,850,731 A | | 12/1998 | Beebe et al. | |
| 6,116,014 A | * | 9/2000 | Dalla Betta et al. | 431/7 |

FOREIGN PATENT DOCUMENTS

| | | |
|---|---|---|
| DE | 196 37 727 | 3/1998 |
| EP | 0 999 413 | 5/2000 |
| GB | 2 100 852 | 1/1983 |

OTHER PUBLICATIONS

Patent Abstracts of Japan; vol. 013, No. 573 (M–909) Dec. 1989 & JP 01239302.
Patent Abstracts of Japan; vol. 013, No. 392 (M–865) Aug. 1989 & JP 01139906.
Patent Abstracts of Japan, vol. 008, No. 101 (P–273) May 1984; JP 59012381.

* cited by examiner

*Primary Examiner*—Charles G. Freay
(74) *Attorney, Agent, or Firm*—Nixon & Vanderhye

(57) ABSTRACT

A device for conditioning the flow of hot gas in a catalytic combustor in preparation for entry into a catalytic reactor. The device is composed of at least one and most preferably two or more disks that are secured to a shroud so as to be disposed in a plane generally perpendicular to the hot gas flow direction. Each disk is composed of a plurality of small cells oriented so that flow channels therethrough are axially disposed. The cells linearize the gas flow and exert drag on the gas flow therethrough. This generates a static pressure gradient in the flow fields upstream and downstream of the honeycomb disk, which in turn causes flow adjustments so as to produce a more uniform axial flow field. This results in a more uniform fuel/air concentration distribution and velocity distribution at the catalytic reactor inlet.

17 Claims, 4 Drawing Sheets

CATALYTIC COMBUSTOR FLOW CONDITIONER AND METHOD FOR PROVIDING UNIFORM GASVELOCITY DISTRIBUTION

BACKGROUND OF THE INVENTION

Catalytic combustion systems are being developed for heavy duty industrial gas turbines in order to achieve extremely low levels of air polluting emissions in the gas turbine exhaust. The emissions to be minimized include the oxides of nitrogen (NOx), carbon monoxide (CO), and unburned hydrocarbons (UHC).

From the outset, it has been recognized that a very uniform flow field would be required at the catalytic reactor inlet in order to meet the emissions performance objectives for the system and obtain the desired service life from the catalytic reactor. Indeed, to function properly, the catalytic reactor in a catalytic combustor must be supplied with an inlet flow field which is uniform in temperature, velocity, pressure and fuel/air concentration distribution. If the catalytic reactor is furnished with a non-uniform flow field at the inlet, two adverse consequences will result. One, the useful service life of the catalytic reactor will be reduced and, two, the emissions performance of the catalytic combustion system will be degraded. These problems result because non-uniform temperature distributions will occur within the catalytic reactor and in the post catalyst reaction zone where the chemical reactions of combustion are completed. Regions of higher than average temperature within the catalytic reactor, so-called "hot spots", will shorten the reactor life by increasing thermal stress and accelerating certain reactor degradation mechanisms such as sintering and oxidation. Regions of higher than average temperature in the post catalyst reaction zone may produce thermal NOx if the local temperature exceeds the thermal NOx generation threshold. This could prevent the system from achieving extremely low NOx levels. Regions of lower than average temperature in the post catalyst reaction zone can cause local quenching of chemical reactions, which results in an increase in CO and UHC emissions. Therefore, uniformity of temperature distribution within the catalytic reactor and in the downstream reacting flow field is important to meeting reactor life objectives and emissions performance objectives.

U.S. Pat. No. 4,966,001, the entire disclosure of which is incorporated herein by this reference, has issued covering a multiple venturi tube (MVT) gas fuel injector for catalytic combustor applications. One objective of this device was to achieve a very uniform fuel/air mixture strength distribution at the catalytic reactor inlet by uniformly distributing the gas fuel over the entire hot gas flow section approaching the catalytic reactor inlet. This device has been used for several laboratory test programs to develop catalytic combustion for heavy duty industrial gas turbines, but the objective for fuel/air mixture strength distribution uniformity at the catalytic reactor inlet (less than +or −5% deviation from the mean) has not been achieved.

SUMMARY OF THE INVENTION

The primary reason for non-uniformity of fuel/air concentration distribution exiting the MVT main fuel injector is non-uniform velocity distribution (mass flux per unit area) in the hot gas flow entering the MVT main fuel injector.

The invention is embodied in a device for conditioning the flow of hot gas in a catalytic combustor in preparation for entry into a catalytic reactor. As explained above, to function properly, the catalytic reactor must be supplied with hot gas flow which is uniform in temperature, velocity, pressure and fuel/air concentration distribution. Accordingly, the invention is embodied in a device for obtaining the uniform flow field required by the catalytic reactor when it is supplied with a non-uniform flow field by upstream components of the catalytic combustor.

The flow conditioner of the invention causes the velocity distribution of the hot gas flow entering the MVT main fuel injector to be more uniform which will result in a more uniform fuel/air concentration distribution and velocity distribution at the catalytic reactor inlet. This will increase the service life of the catalytic reactor by avoiding "hot spots" and will improve the emissions performance of the catalytic combustion system.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

The flow conditioner of the invention was developed to ensure that the catalytic reactor is supplied with a uniform inlet flow field so that the temperature distribution within the catalytic reactor and post catalyst reaction zone is uniform.

Figure 1:
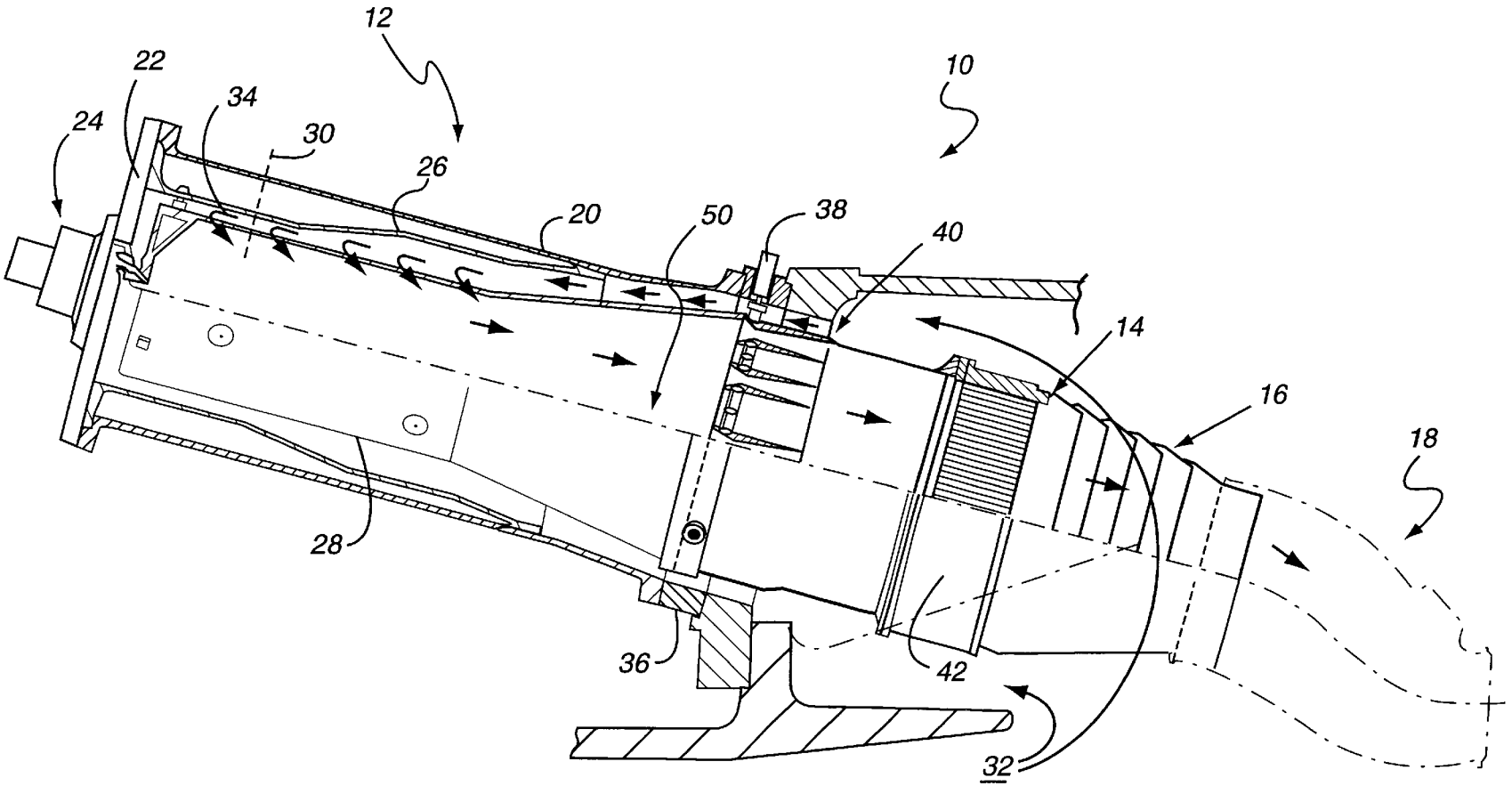
FIG. 1 is a schematic cross-section of a catalytic combustor for a heavy-duty industrial turbine.

FIG. 1 illustrates in cross-section a catalytic combustor for a heavy-duty industrial gas turbine in which the flow conditioner of the invention may be advantageously disposed.

Referring more specifically to the structure illustrated in FIG. 1, there is shown generally at 10 a combustor for a gas turbine engine and including a pre-burner section 12, a catalytic reactor assembly 14, a main combustion assembly 16 and a transition piece 18 for flowing hot gases of combustion to the turbine blades (not shown). The pre-burner assembly 12 is located upstream of the catalytic reactor assembly 14 for the purpose of elevating the temperature of the gas entering the reactor to the level required to achieve catalytic ignition and sustain the catalytic reactions. The pre-burner assembly 12 includes a preburner casing 20, a preburner end cover 22, a start up fuel nozzle 24, a flow sleeve 26, and a preburner liner 28 disposed within sleeve 26. An ignitor 30 is provided and may comprise a spark or glow plug. Combustion in the preburner assembly 14 occurs within the preburner liner 28. Compressor discharge air 32 is directed via flow sleeve 26 and into liner 28 as preburner combustion air 34. The air 34 enters the liner under a pressure differential across liner 28 and mixes with fuel from fuel nozzle 24 within liner 28. Consequently, a diffusion flame combustion reaction occurs within liner 28 releasing heat flow for purposes of driving the gas turbine, and igniting the chemical reactions in the catalytic reactor 42.

The catalytic combustion zone includes the reactor assembly 14 and combustion assembly 16. In the region upstream of the catalytic combustion zone, there is provided a main fuel injector mounting ring 36 through which fuel is supplied via primary fuel supply piping, 38. For example, this might take the form of the multiple venturi tube gas fuel injector 40 described and illustrated in U.S. Pat. No. 4,845,952, the disclosure of which is incorporated herein by this reference. Thus, the mixture of hydrocarbon fuel and preburner products of combustion enters the catalytic reactor bed via the catalytic reactor assembly liner. The catalytic reactor bed 42 is generally cylindrical in shape and may be formed from a ceramic material or substrate of honeycombed cells coated with a reaction catalyst. The reaction catalyst may, for example, comprise palladium. The structure of the catalytic reactor bed 42 may be as described and illustrated in U.S. Pat. No. 4,794,753, the disclosure of which is incorporated herein by reference.

As noted above, the preburner is provided for the purpose of elevating the temperature of the gas entering the reactor to the level required to achieve catalytic ignition and sustain the catalytic reactions. It has been learned through analysis and experimental measurement that the preburner produces a flow field with center peaked velocity distribution at its exit plane. This center peaked velocity distribution persists through the main fuel injector which provides fuel for the catalytic reactor. The result is a non-uniform fuel/air concentration distribution at the catalytic reactor inlet with a weaker than average mixture at the center of the flow field where the velocity is higher and a stronger mixture towards the perimeter of the flow field where velocity is relatively low.

Figure 4:
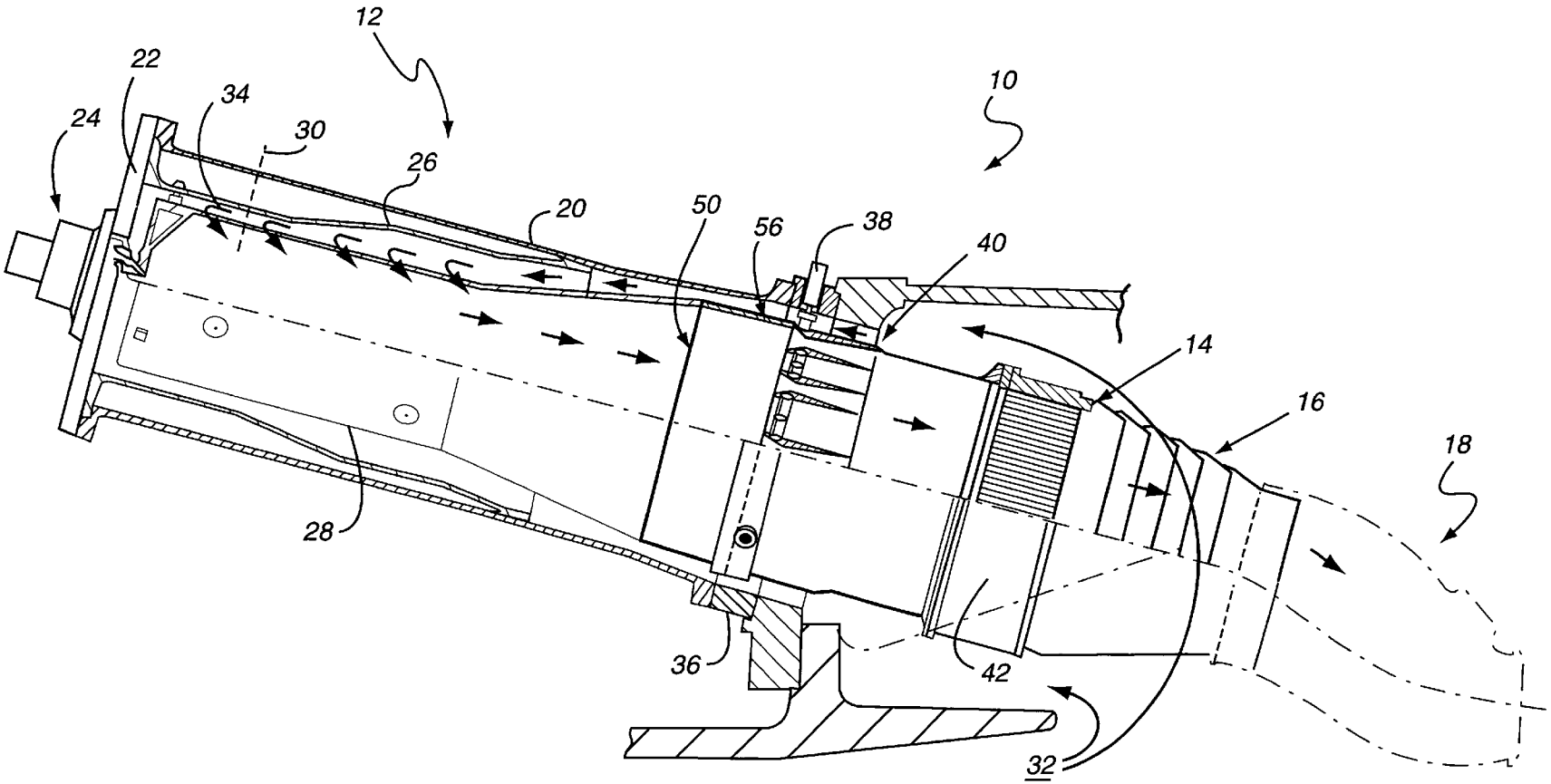
FIG. 4 is a schematic cross-sectional view similar to FIG. 1, schematically illustrating the disposition of a flow conditioner embodying the invention.

A flow conditioner embodying the invention is adapted to be located at the exit of the preburner, in the area labeled with reference number 50 in FIG. 1 and as schematically shown in FIG. 4, and will convert the center peaked velocity distribution into one which is more uniformly distributed over the inlet surface of the main fuel injector. The result is a flow field at the catalytic reactor inlet which is more uniform in fuel/air concentration distribution and velocity distribution.

As mentioned above, the flow conditioner of the invention is used to obtain a uniform distribution of hot gas velocity at the inlet of the multi-venturi tube (MVT) main fuel injector 40 of a catalytic combustion system. The flow conditioner receives a non-uniform hot gas velocity distribution from the preburner of the catalytic combustion system, which may be a center-peaked parabolic velocity distribution as indicated at 52 in FIG. 3 and converts this flow to a uniform velocity distribution downstream as shown at 54, on the right side of FIG. 3. With the flow conditioner 56 of the invention working in combination with the MVT main fuel injector 40, shown in FIG. 3, a flow field with uniform fuel/air concentration distribution and velocity distribution is obtained at the inlet of the catalytic reactor 42. A uniform flow field at the inlet to the catalytic reactor 42 is necessary to meet reactor service life objectives and the system emissions performance objectives.

Figure 3:
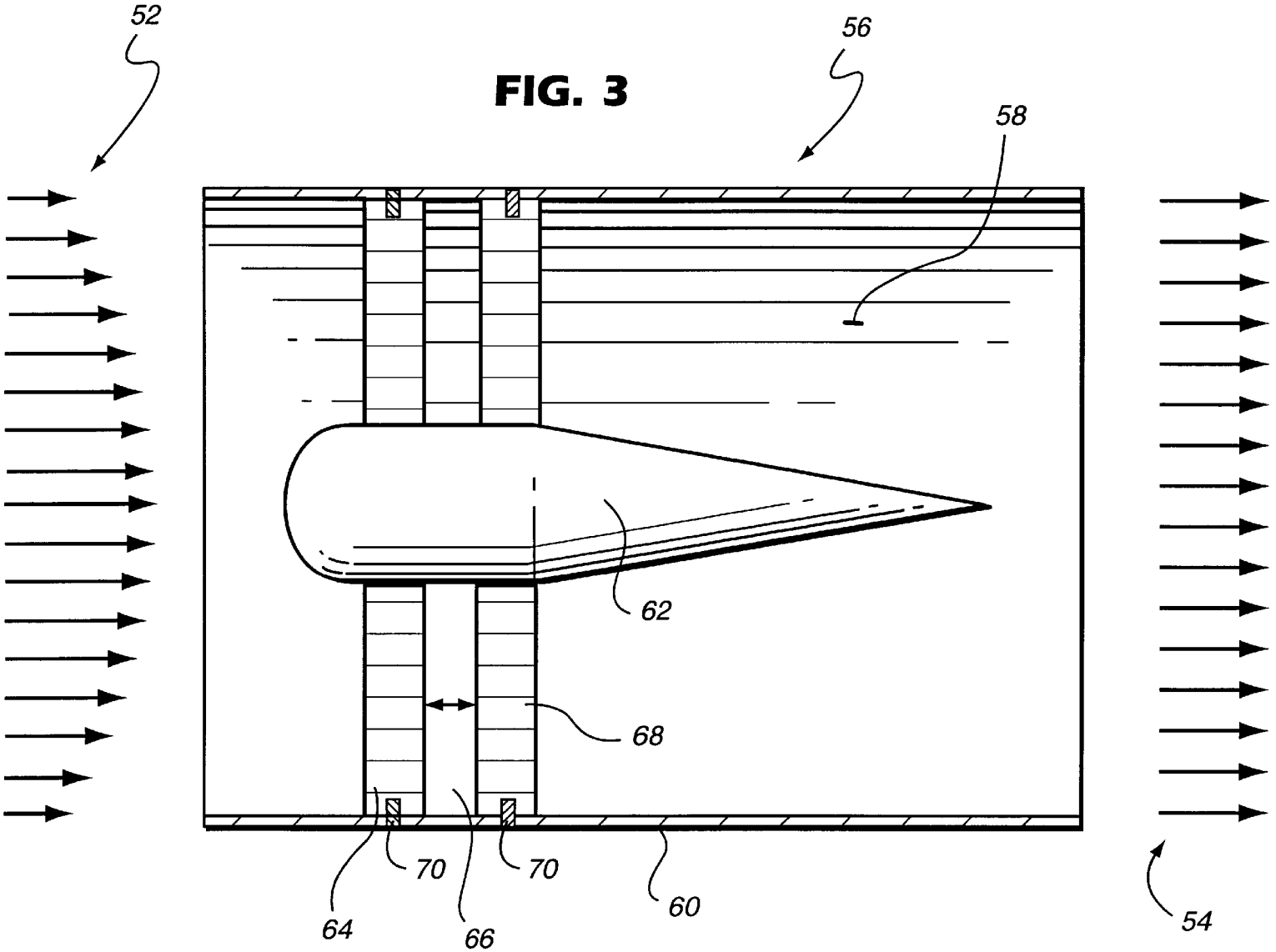
FIG. 3 is a partial cross-sectional view of a catalytic combustor flow conditioner embodying the invention.

FIG. 3 is a schematic cross-section through a flow conditioner 56 embodying the invention. In a catalytic combustor, as mentioned above, the flow conditioner 56 is located between the preburner 12 and the main fuel injector 40 as shown at 50 in FIG. 1. Parts of the flow conditioner 56 can be made integral with the preburner combustion liner 28, or the main fuel injector 40, or both. Referring to FIG. 3, the flow conditioner 56 defines a cylindrically shaped hot gas flow path 58 which is bounded at the outside diameter by a shroud 60 and at the inside diameter by a center-body 62. The flow conditioner 56 receives hot gas flow at its inlet from the preburner 12 with a non-uniform velocity distribution 52, which is shown as velocity vectors of varying magnitude in FIG. 3. This velocity distribution is shown as 1-dimensional (axial) vectors for illustration purposes in FIG. 3, but the flow field will actually be 3-dimensional in practice, having radial and tangential velocity components which are not included in FIG. 3 for clarity. At least one and most preferably two or more disks 64, 68 are secured to the shroud so as to be disposed in a plane generally perpendicular to the hot gas flow direction. Each disk is composed of a plurality of small cells oriented so that flow channels therethrough are axially disposed. The cells linearize the gas flow and exert drag on the gas flow therethrough. This generates a static pressure gradient in the flow fields upstream and downstream of the honeycomb disk, which in turn cause flow adjustments so as to produce a more uniform axial flow field.

More particularly, with reference to the illustrated embodiment, the flow 52 from the preburner enters a honeycomb disk 64 which is the first of two or more such disks in the flow conditioner assembly 56. The honeycomb disk 64 consists of a multiplicity of small cells evenly distributed over the cross-section of the disk 64 and forming open channels which are axially disposed. The cells may be hexagonal in shape and may be formed by metal foils that are braised and/or welded together. Components of the flow field 52 that are radial or tangential are eliminated as the flow traverses these channels, since those velocity components are normal to the cell walls which are impermeable to flow. As the axial flow traverses the channels, drag is exerted on the flow due to friction between the flowing gas and the stationary channel walls. This drag is proportional to the square of the velocity of the hot gas flow within the channels and causes a reduction in the velocity and an increase in static pressure. Cells with greater than average velocity will have a greater than average static pressure increase and those with lower than average velocity will have less than average static pressure increase. This effect causes static pressure gradients to exist in the flow field upstream of honeycomb disk 64 and in the gap 66 between honeycomb disk 64 and honeycomb disk 68. The drag of fluid friction also causes pressure drop across the honeycomb disks 64, 68 and the resulting load on the honeycomb disk can be transmitted to the surrounding shroud 60 through radial pins 70. This construction also permits radial differential thermal expansion between the honeycomb disk 64 and 68 and the shroud 60.

Figure 2:
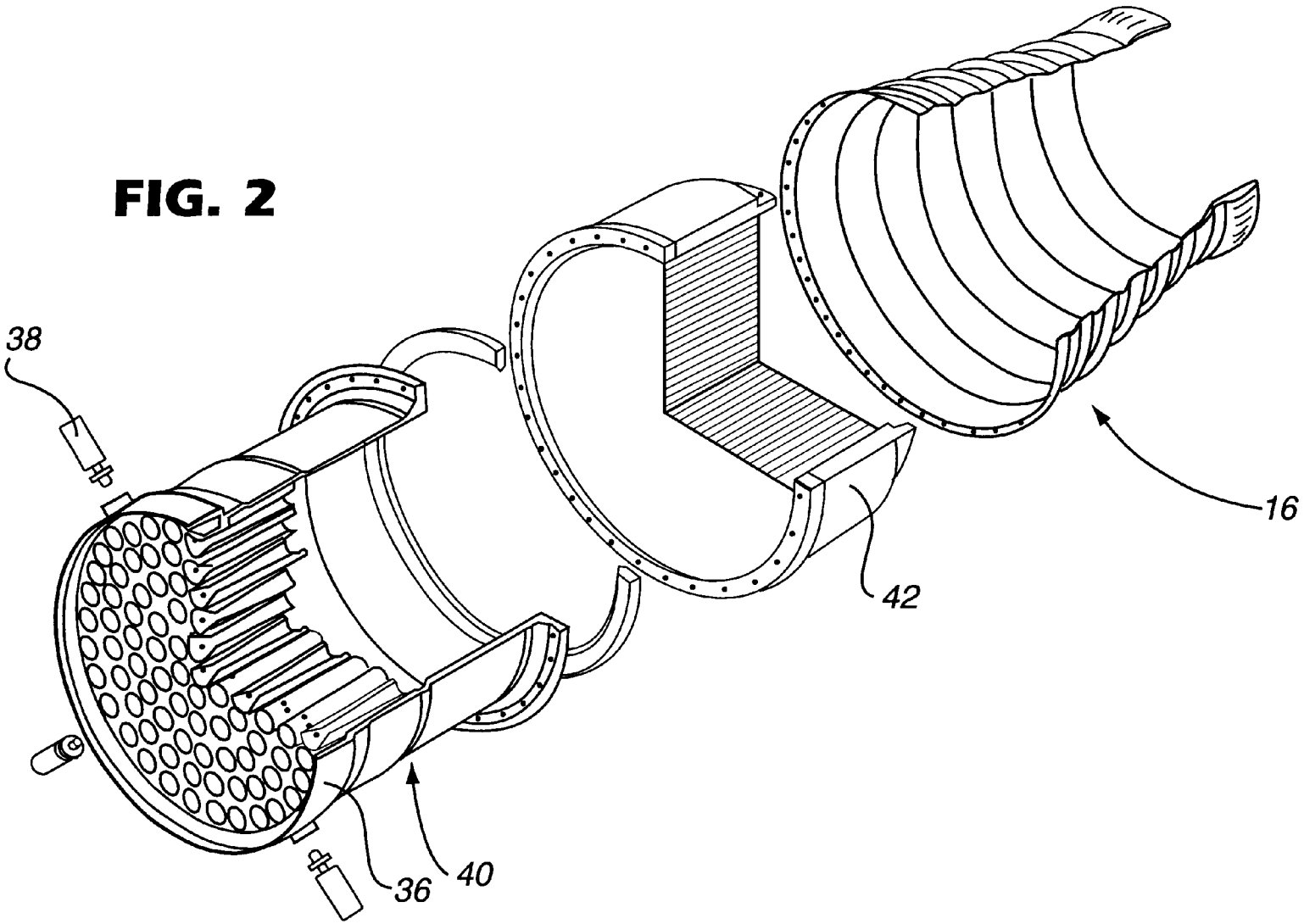
FIG. 2 is an exploded perspective view of a catalytic reactor sub assembly and main fuel injector of the combustor of FIG. 1.

The static pressure gradients in the flow field created by frictional drag in the honeycomb channels cause flow in the radial and/or tangential directions upstream of the honeycomb disk 64 and 68. The flow moves from regions of high velocity, where static pressure is highest, to regions of low velocity where static pressure is lowest. The net effect of this flow adjustment is to produce a generally uniform axial flow field depicted schematically as uniform axial velocity vectors 54 in FIG. 3. This flow field works in conjunction with the MVT main fuel injector 40 (FIGS. 1 and 2) which disperses gas fuel generally uniformly over the flow field cross-section, to produce a flow field at the catalytic reactor inlet which is generally uniform in fuel/air concentration distribution and velocity distribution.

An analysis of the flow conditioner of the invention using computational fluid dynamics (CFD) has predicted that a single stage flow conditioner of the type depicted in FIG. 3 will reduce the velocity variation from an catalytic combustor preburner, which is center peaked with 29% variations from maximum to minimum, to a more uniform velocity distribution with a 6% variation from maximum to minimum.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims. Accordingly, while an embodiment of the invention has been illustrated and described that provides two honeycomb disks 64 and 68 with one intermediate gap 66, it is to be understood that the invention may be embodied in a flow conditioner that has been made more effective at producing uniform flow by adding more stages of flow conditioning where each additional stage includes another gap such as gap 66 and another honeycomb disk such as disk 68. Thus, the invention may be embodied in a flow conditioner with one or more stages even though FIG. 3 depicts only a single stage for simplicity.

What is claimed is:

1. A combustor for a gas turbine engine comprising:

a preburner;

a gaseous fuel inlet to said preburner;

a combustion air inlet to said preburner;

a main fuel injector downstream of said preburner;

a catalyst bed downstream of said main fuel injector; and a flow conditioner disposed at an exit end of the preburner, upstream of said main fuel injector for providing a generally uniform distribution of hot gas velocity at an inlet to said main fuel injector.

2. A combustor as in claim 1, wherein said main fuel injector includes a plurality of parallel venturi tubes and a support for said plurality of parallel venturi tubes, said support including primary fuel supply piping for feeding a gaseous fuel to said plurality of venturi tubes.

3. A combustor as in claim 1, wherein said flow conditioner comprises at least one disk defining a plurality of small cells for air flow therethrough, said cells being defined so that longitudinal axes thereof are disposed in parallel to one another and to a direction of axial air flow through said combustor.

4. A combustor as in claim 3, wherein each said disk is mounted to a circumferential wall defining a cylindrically shaped hot gas flow path.

5. A combustor as in claim 3, wherein the flow conditioner includes a shroud defining an outer peripheral support structure for said at least one disk.

6. A combustor as in claim 5, wherein said flow conditioner further comprises a center body disposed concentric to said shroud.

7. A combustor as in claim 3, wherein each said disk is formed from foils of material that is substantially impermeable to gas flow.

8. A combustor as in claim 7, wherein each said disk is formed from metal foils that are at least of braised and welded together to define said cells.

9. A combustor as in claim 3, wherein there are at least two cell defining disks, an axial gap being defined between said disks.

10. A method of providing a uniform distribution of hot gas velocity at an inlet to a main fuel injector of a catalytic combustion system comprising:

providing a flow conditioner for receiving hot gas velocity distribution from a preburner of a catalytic combustion system to receive and convert said hot gas velocity distribution to a generally uniform velocity distribution for flow into said main fuel injector.

11. A method as in claim 10, wherein said main fuel injector includes a plurality of parallel venturi tubes and a support for said plurality of parallel venturi tubes, further comprising the step of feeding a gaseous fuel to said plurality of venturi tubes via primary fuel supply piping.

12. A method as in claim 10, wherein said step of providing a flow conditioner comprises disposing at least one disk defining a plurality of small cells for air flow therethrough upstream of said main fuel injector so that longitudinal axes of said cells are disposed in parallel to one another and to a direction of axial air flow through said combustor.

13. A method as in claim 12, including mounting each said disk to a circumferential wall defining a cylindrically shaped hot gas flow path.

14. A method as in claim 12, including mounting each said disk to a shroud defining a cylindrically shaped hot gas flow path.

15. A method as in claim 12, further comprising forming each said disk from foils of material that is substantially impermeable to gas flow.

16. A method as in claim 12, further comprising forming each said disk by at least one of braising and welding metal foils that are substantially impermeable to gas flow to define said cells.

17. A method as in claim 12, wherein there are at least two cell defining disks, said disks being mounted so as to define an axial gap therebetween.

* * * * *